US006899642B2

(12) United States Patent
Morgan et al.

(10) Patent No.: US 6,899,642 B2
(45) Date of Patent: May 31, 2005

(54) GOLF BALL WITH A LAYER INCLUDING COMPOSITE MATERIAL AND A METHOD FOR MAKING SUCH A GOLF BALL

(75) Inventors: William E Morgan, Barrington, RI (US); Kevin M Harris, New Bedford, MA (US); Laurent Bissonnette, Portsmouth, RI (US); Murali Rajagopalan, South Dartmouth, MA (US); Shenshen Wu, North Dartmouth, MA (US); Manjari Kuntimaddi, New Bedford, MA (US)

(73) Assignee: Acushnet Company, Fairhaven, MA (US)

( * ) Notice: Subject to any disclaimer, the term of this patent is extended or adjusted under 35 U.S.C. 154(b) by 11 days.

(21) Appl. No.: 10/103,593

(22) Filed: Mar. 21, 2002

(65) Prior Publication Data

US 2003/0181261 A1 Sep. 25, 2003

(51) Int. Cl.[7] ..... A63B 37/06
(52) U.S. Cl. ..... 473/374
(58) Field of Search ..... 473/351, 373, 473/374, 376, 377, 378

(56) References Cited

U.S. PATENT DOCUMENTS

| | | | | |
|---|---|---|---|---|
| 3,241,834 A | | 3/1966 | Stingley | 273/58 |
| 3,313,545 A | | 4/1967 | Bartsch | 273/218 |
| 4,431,193 A | | 2/1984 | Nesbitt | 273/235 |
| 4,473,229 A | | 9/1984 | Kloppenburg et al. | 273/225 |
| 4,593,418 A | * | 6/1986 | Simon | 2/275 |
| 4,955,966 A | | 9/1990 | Yuki et al. | 273/218 |
| 5,141,233 A | | 8/1992 | Yuki et al. | 273/218 |
| 5,713,801 A | | 2/1998 | Aoyama | 473/354 |
| 5,913,736 A | | 6/1999 | Maehara et al. | 473/360 |
| 6,012,991 A | | 1/2000 | Kim et al. | 473/374 |
| 6,142,887 A | | 11/2000 | Sullivan et al. | 473/374 |
| 6,183,382 B1 | | 2/2001 | Kim et al. | 473/374 |
| 2003/0114250 A1 | * | 6/2003 | Nesbitt | 473/371 |

* cited by examiner

*Primary Examiner*—Raeann Gorden

(57) ABSTRACT

A golf ball with a layer formed of a composite material is disclosed. The composite layer can be the outermost cover layer, an intermediate layer, or a layer of a center of the ball. The composite layer includes a filament material embedded in a matrix material. The filament material is selected such that it can sustain sufficient deformation at impact and remain elastic, i.e. essentially deforming with as little energy loss as possible. As a result, the composite cover layer contributes significantly to the resiliency of the ball and acts as a hoop-stress layer.

25 Claims, 6 Drawing Sheets

GOLF BALL WITH A LAYER INCLUDING COMPOSITE MATERIAL AND A METHOD FOR MAKING SUCH A GOLF BALL

FIELD OF THE INVENTION

The present invention relates to golf balls and more particularly, the invention is directed to golf balls with an improved layer including a composite material and a method for making such golf balls.

BACKGROUND OF THE INVENTION

Conventional golf balls can be divided into two general types or groups: solid balls or wound balls. The difference in play characteristics resulting from these different constructions can be quite significant. These balls, however, have primarily two functional components that make them work. These components are the core and the cover. The primary purpose of the core is to be the "spring" of the ball or the principal source of resiliency. The primary purpose of the cover is to protect the core.

Two-piece solid balls are made with a single-solid core, usually made of a crosslinked polybutadiene or rubber, which is encased by a hard cover material. In these balls, the solid core is the "spring" or source of resiliency. The resiliency of the core can be increased by increasing the crosslink density of the core material. As the resiliency increases, however the compression may also increase making a ball with increased stiffness. Stiffness is a physical attribute defined by load per unit of deflection. In the golf ball art, stiffness is commonly measured using Atti and Rheile "compression" gauges, however, other methods can be used.

Multi-piece solid balls include multi-layer core constructions or multi-layer cover constructions, and combinations thereof. In a golf ball with multi-layer core, the principal source of resiliency is the multi-layer core. In a golf ball with a multi-layer cover, the principal source of resiliency is the single-layer core.

Wound balls, on the other hand, typically have either a solid rubber or fluid-filled center around which many yards of a stretched thread or yarn are wrapped to form a wound core. The wound core is then covered with a durable cover material that adheres to the wound core. Since stretched threads or yarns are extremely resilient, the wound layer acts as the "spring" or source of resiliency for wound balls. The wound balls achieve high resiliency while having a much lower compression than can be achieved with solid cores of similar resiliency. In a wound ball, the center functions primarily as the point about which the winding process begins. The solid center may have some small influence on the ball's overall resiliency, but the principle "spring" of the ball is the wound layer. The fluid in a fluid-filled center can act as a third design element in the ball, but does not substantially contribute to resiliency of the ball.

Attempts have been made in recent years to improve the efficiency of the wound layer by using different winding techniques, different thread materials, or layering the windings. While these solutions have lead to improvements in resiliency or altered the spin of wound balls, none of these improvements alters the fact that the windings act as the "spring" or main source of resiliency in the ball.

Another type of ball has evolved which employs a very large core and a very thin layer of elastic windings that forms a hoop-stress layer. In many golf balls, the ball diameter is about 1.68 inches. In such golf balls with a large core, the core has a diameter of between 1.50 and 1.63 inches. In such golf balls, the thickness of the thin wound layer is between 0.01 and 0.10 inches. In one example, the large core includes a center and a layer of conventional windings subsequently wound with threads that form a hoop-stress layer. U.S. Pat. No. 5,713,801 to Aoyama discloses such a golf ball. The hoop-stress layer aids in rapidly returning the core to its spherical shape, and is a separate layer from the cover or core. The hoop-stress layer has about the same thickness as inner cover layers on many double-cover designs. Though most of the ball's resiliency comes from the core, the contribution of the wound hoop-stress layer to resiliency is significant.

Golf balls with diameters greater than 1.68 inches may be called "oversized" golf balls. In such "oversized" golf balls, the ball diameter can exceed 1.72 inches. Golf balls with diameters significantly less than 1.68 inches may be called "British" golf balls. In such "British" golf balls, the ball diameter can be as small as 1.62 inches. In either "oversized" or "British" golf balls the core can have different sizes, but the thickness of the hoop-stress layer will remain the same as in the large core golf ball (i.e., between 0.01 and 0.10 inches).

As discussed above, the primary purpose of the cover is to protect the "spring." Different covers vary in the types of protection they provide, and different cores have different protection requirements. Polybutadiene cores in solid balls are adversely affected by moisture, and their covers should have good moisture barrier properties and should be applied to the cores soon after their formation. On the other hand, if a wound core is exposed to air, the windings may oxidize rapidly and lose their resiliency. As a result, wound balls require covers that protect them from oxidation. Additionally, the thread of wound cores should also be prevented from unraveling. Balls with wound hoop-stress layers must be protected from oxidation and unraveling similarly to wound cores. Furthermore, if balls with wound hoop-stress layers have large solid cores, they must also be protected from moisture similarly to solid cores. As a result, the cover of balls with wound hoop-stress layers must be selected with these requirements in mind.

A strong correlation has been observed between the stiffness of the cover and the resiliency of the ball. The stiff or hard ionomer covers can function as a hoop-stress layer providing both core protection and improved resilience. However, the better a cover functions as a hoop-stress layer, the harder it feels and the worse it performs greenside. When a stiff ionomer is used as an inner cover, the inner cover materials although providing hoop-stress typically cannot match the resiliency of a layer of stretched rubber thread (i.e., wound hoop-stress layer) of the same thickness.

Hence, there remains a need for a cover design that will provide improved resilience while also having good abrasion durability, good hardness, and friction characteristics that result in favorable spin.

SUMMARY OF THE INVENTION

The present invention is directed to a golf ball with a center and at least one layer surrounding the center. The layer comprises at least in part a composite material that comprises a matrix material and a filament material embedded in the matrix material. A ratio of a filament material tensile modulus to a matrix material tensile modulus is between about 20 and about 120.

According to another aspect of the present invention, an ultimate tensile strain of the filament material can be at least or greater than about 4%.

In one embodiment, the layer is a single cover layer that forms the outer surface of the golf ball. In another embodiment, the golf ball includes a multi-layer cover where one layer comprises composite material.

In yet another embodiment, the filament material can be formed of a single fiber or a plurality of fibers. The plurality of fibers can be formed into multi-fiber bundles or into woven or non-woven mats. Preferably, the filament material can be formed of glass fibers, fibers of polymeric materials, fibers of shape memory alloys or a combination thereof. In one embodiment, the filament material can be surface treated with a coupling agent.

The present invention is also directed to a golf ball with a center and at least one cover layer surrounding the center. The cover layer comprises at least in part a composite material that comprises a matrix material and a filament material embedded in the matrix material. The composite material has a tensile modulus between about 20,000 psi and 250,000 psi.

In addition, the present invention is directed to a golf ball with a center and at least one cover layer surrounding the center. The cover layer comprises at least in part a composite material that comprises a matrix material and a filament material embedded in the matrix material. The matrix material has a first tensile modulus less than 80,000 psi, and the filament material has a second tensile modulus greater than the first tensile modulus.

According to another aspect of the present invention, the first tensile modulus is greater than about 500 psi. According to yet another aspect of the present invention, the tensile modulus of the filament material is preferably greater than about 30,000 psi.

The present invention is further directed to a golf ball with a center and at least one layer surrounding the center. The layer comprises at least in part a composite material that comprises a matrix material and a filament material embedded in the matrix material. An ultimate tensile strain of the filament material can be at least or greater than about 4%. More preferably, the filament material has an ultimate tensile strain of at least or greater than about 8%. In one embodiment, the layer with a composite material is a cover layer that forms the outer surface of the golf ball.

The present invention is also directed to a method of making a golf ball comprising the steps of providing a center and forming at least one cover layer thereon. The step of forming at least one cover layer includes forming a composite material by providing a filament material with an ultimate tensile strain greater than about 4%, and embedding the filament material in a matrix material.

According to one aspect of the method, the step of providing a filament material further includes winding the filament material about the center. In such a method, a winding pattern can be an axial winding pattern or a biaxial winding pattern.

Alternatively, the step of providing a filament material further includes forming the filament material into a mat, forming the mat into a pair of hemispherical shells, and locating the hemispherical shells about the center.

In one embodiment, the step of embedding further includes molding the matrix material onto the center surrounded by the filament material.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
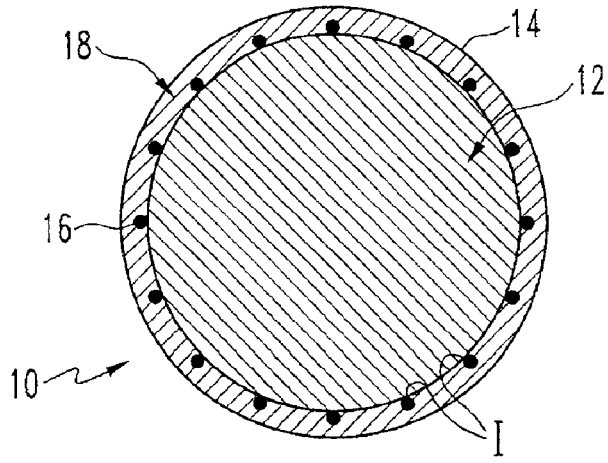
FIG. 1 is a schematic, cross-sectional view of a golf ball according to a first embodiment of the present invention with a center and a cover layer formed of a composite material.

Referring to FIG. 1, golf ball 10 is shown. Golf ball 10 includes a center 12 surrounded by at least one cover layer 14 formed of a composite material. The center 12 may be of any dimension or composition, such as thermoset solid rubber, a thermoplastic, metal, or any material known to one skilled in the art of golf ball manufacture. Preferably, the center 12 comprises a resilient polymer such as polybutadiene, natural rubber, polyisoprene, styrene-butadiene, or ethylene-propylene-diene rubber or highly neutralized polymers. This base material may be combined with other components as known by one of ordinary skill in the art. The base composition can be mixed and formed using conventional techniques to produce the center 12. Alternatively, the center 12 can include a spherical inner core and an outer core layer surrounding the inner core. The inner core and outer core layer can be molded or non-wound. In an alternative embodiment, the center can include a fluid and/or windings disposed thereon.

In the golf ball 10, there is only a single cover layer 14, which forms the outer surface of the golf ball. The cover layer 14 can optionally be formed with a plurality of dimples or surface protrusions defined on the outer surface thereof. The composite material forming the cover layer 14 includes a filament material 16 embedded in a matrix or binder material 18. The filament material 16 in this embodiment is a fiber wound about the center 12 as discussed below.

The filament material may be a single fiber or formed of more than one fiber or a plurality of fibers (i.e., multi-fiber tow or bundle). Preferably, each fiber has an aspect ratio defined by average fiber length over average fiber diameter that is greater than about 10,000.

An interface I is formed where the filament material 16 contacts the center 12. Since the filament material 16 is at least partially embedded in the matrix material or at least partially surrounded by the matrix material, the interface I is discontinuous. Alternatively, the interface I can be continuous.

Although the filament material 16 is shown with the windings spaced from one another, the windings can contact one another. The cover layer 14 may have a thickness of less than about 0.2 inches, preferably between about 0.02 and about 0.1 inches. Most preferably, this thickness is between about 0.03 inches and about 0.07 inches.

Preferably, the tensile modulus of filament material 16 is greater than the tensile modulus of the matrix material 18. More preferably, the filament material has a tensile modulus or Young's modulus greater than about 30,000 psi. As used herein, tensile modulus of the filament material is defined in accordance with the ASTM D-3379-75 for single fiber filament material. To measure the tensile modulus for multi-fiber tows ASTM D-4018-81 may be used. To measure the tensile modulus or Young's modulus of the matrix material ASTM D-638-01 may be used.

This preferred range of tensile modulus of the filament material along with the thickness of the cover layer allows the cover 14 to function as a hoop-stress element. The hoop-stress cover prevents the center 12 from becoming excessively deformed after being hit, and rapidly returns the center 12 to its spherical shape. The filament material is selected such that it can sustain sufficient deformation at impact and remain elastic, i.e. essentially deforming with as little energy loss as possible. As a result, the composite cover layer contributes significantly to the resiliency of the ball.

The filament material 16 may be formed of fibers of polymeric materials, glass materials, or metal fibers, among others. The filament material may also be comprised of strands or fibers having different physical properties to achieve desired stretch and elongation characteristics. Suitable polymers for the filament material include polyether urea, such as LYCRA®, poly(ester-urea), polyester block copolymers such as HYTREL®, poly(propylene), polyethylene, polyamide, acrylics, polyketone, poly (ethylene terephthalate) such as DACRON®, poly(p-phenylene terephthalamide) such as KEVLAR®, poly (acrylonitrile) such as ORLON®, trans-diaminodicyclohexylmethane and dodecanedicarboxylic acid such as QUINA®, poly(trimethylene terephthalate) as disclosed in U.S. Pat. No. 6,232,400 by Harris et al. or SURLYN®. LYCRA®, HYTREL®, DACRON®, KEVLAR®, ARAMID®, ORLON®, QUINA®, and SURLYN® are available from E. I. DuPont de Nemours & Co. SPECTRA® from the Honeywell Co. can also be used. Exemplary commercially available glass fibers that can be used are S-GLASS® from Corning Corporation.

By way of example, metal fibers that can be use for the filament material can be formed of shape memory alloys (SMA). Examples of SMA materials that can be used are Ag—Cd, Cu—Al—Ni, Cu—Sn, Cu—Zn, Cu—Z—X (X=Si, Sn, Al), In—Ti, Ni—Al, Ni—Ti, Fe—Pt, Mn—Cu, and Fe—Mn—Si, however the present invention is not limited to these particular SMA materials. The filament material can include at least some fibers formed of a SMA, can include fibers that are all SMA, can include fibers that include some or all non-shape memory alloy materials, or the filament material can include a blend of SMA fibers and non-SMA fibers. For example, the filament material can include a Ni—Ti SMA fiber along with non-SMA fiber, such as carbon/epoxy fiber, to provide enhanced tensile strength in comparison to composites with only non-SMA fiber.

It is preferred that the filament material has an ultimate tensile strain of greater than or equal to about 4%. More preferably, the filament material has an ultimate tensile strain of greater than or equal to about 8%. Ultimate tensile strain for the filament material may be determined according to ASTM D-3379-75. In addition, preferably, the fibers forming the filament material have a diameter of less than about 0.01 inches, and more preferably less than about 0.002 inches. The polymeric threads are preferably formed by methods such as melt spinning, wet spinning, dry spinning and polymerization spinning, as disclosed in U.S. Pat. No. 6,149,535 to Bissonnette et al., which is incorporated herein by reference in its entirety.

Preferably, the matrix material 18 is selected such that the cover is soft and compliant, but also provides an outer surface with sufficient friction to impart adequate spin on the ball for greenside performance. To that end, the matrix material preferably has a tensile modulus less than about 80,000 psi and/or greater than about 500 psi. More preferably, the tensile modulus of the matrix material is less than about 30,000 psi, and most preferably the tensile modulus of the matrix material is about 10,000 psi.

The matrix material 18 may be molded about the filament material 16 so that the filament material 16 is embedded in the matrix material 18, as discussed above. In this embodiment, the matrix material 18 can be a thermoset or a thermoplastic polymer. Preferred thermoset polymeric materials are, for example, unsaturated polyester resins, vinyl esters, epoxy resins, phenolic resins, polyurethanes, polyurea, polyimide resins, and polybutadiene resins. Preferred thermoplastics are, for example, polyethylene, polystyrene, polypropylene, thermoplastic polyesters, acrylonitrile butadiene styrene (ABS), acetal, polyamides including semicrystalline polyamide, polycarbonate (PC), shape memory polymers, polyvinyl chloride (PVC), polyurethane, trans-polybutadiene, liquid crystalline polymers, polyether ketone (PEEK), bio(maleimide), and polysulfone resins.

The matrix material can also be a silicone material, such as a silicone polymer, a silicone elastomer, a silicone rubber, silicone resins, or a low molecular weight silicone fluid, thermoplastic silicone urethane copolymers and variations, and the likes. Silicone polymers include silicone homopolymers, silicone random copolymers, and silicone-organic (block) copolymers. Silicone elastomers are defined as high-molecular-weight linear polymers, usually polydimethysiloxanes. Silicone rubbers include commercially available gums, filler-reinforced gums, dispersions, and uncatalyzed and catalyzed compounds. Silicone resins contain Si atoms with no or only one organic substituent; they are therefore crosslinkable to harder and stiffer compounds than the elastomers. Low molecular weight silicone fluids including oligomers. Recommended silicone materials are disclosed in U.S. Pat. No. 6,162,134 to Sullivan, et al. and U.S. Pat. No. 6,159,110 to Sullivan, et al. incorporated by reference herein in their entirety.

The matrix can also be formed of ionomers including highly neutralized polymers, or blends of the above materials. The specific formulations of these materials may include additives, fillers, inhibitors, catalysts and accelerators, and cure systems depending on the desired performance characteristics. The matrix material can be at least one polymer or a blend of polymers. In one preferred embodiment, the matrix material 18 is Nylon, which is commercially available from BASF in Parsippany, N.J. under the name Ultramid. The details of forming the cover layer 14 are discussed below.

The filament material and/or the matrix can be optionally surface treated with a suitable coupling agent or bonding agent or binder. This coupling agent is located at the interface I (as shown in FIG. 1) of the filament material and matrix material and will improve their adhesion and reduce the number of voids present in the matrix material. A void is an air pocket in the matrix material that is undesirable because the matrix material does not support the fiber passing through a void is the matrix. Such an unsupported fiber under a load may buckle and transfer the stresses to the matrix, which could cause the matrix to crack. The coupling agents can be functional monomers, oligomers and polymers. The functional groups include, but are not limited to, maleic anhydride, maleimide, epoxy, hydroxy amine, silane, titanates, zirconates, and aluminates.

The filament and matrix materials used in the inventive golf ball may consider the differences in coefficient of thermal expansion properties of the filament material and the matrix material. Preferably, the thermal expansion properties of the filament material and the matrix material allow the composite formed thereof to deform substantially uniformly under thermal stress. If the composite is not allowed to deform uniformly under thermal stress, microcracking of the matrix material and de-bonding at the fiber/matrix interface can occur. By way of example, preferably to optimize the thermal expansion properties of the composite as discussed above the following thermal ratio can be defined:

$$R_T = \frac{CE_M}{CE_F}$$

and preferably $R_T$ is less than about 20 and more preferably $R_T$ is less than about 10. In the ratio $R_T$ $CE_M$ is the coefficient of thermal expansion of the matrix material and $CE_F$ to a coefficient of thermal expansion of the filament material.

Preferably, the composite material forming the cover 14 has a tensile or Young's modulus $E_C$ between about 20,000 psi and about 250,000 psi. The tensile modulus for the composite may be defined in accordance with ASTM D-3039. The composite material tensile modulus along the fiber direction may be computed from the constituent fiber and matrix tensile module as follows:

$$E_C = E_F V_F + E_M V_M$$

where, $E_C$ is the tensile modulus of the composite, $E_F$ is the tensile modulus of the filament material, $V_F$ is the volume fraction of filament material, $E_M$ is the tensile modulus of the matrix material, and $V_M$ is the volume fraction of matrix material.

The volume fractions $V_F$ and $V_M$ may be measured in accordance with ASTM D-3171. Preferably, a ratio R is defined as follows:

$$R = \frac{E_F}{E_M}$$

and preferably R is between about 20 and about 120.

Figure 2:
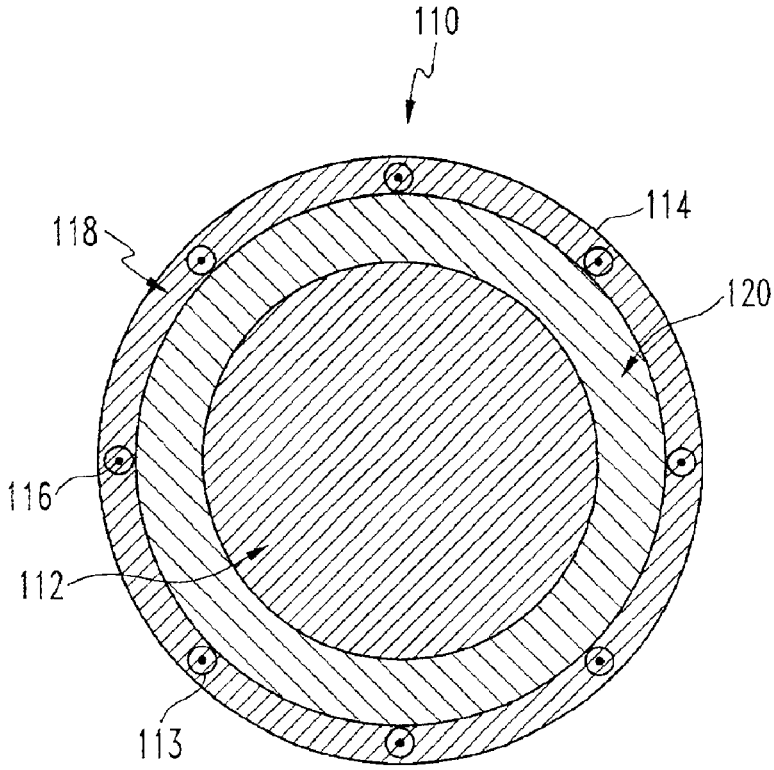
FIG. 2 is a schematic, cross-sectional view of a golf ball according to a second embodiment of the present invention with a center, an intermediate layer and a cover layer formed of the composite material.

Referring to FIG. 2, golf ball 110 is shown. Golf ball 110 includes center 112 and cover layer 114. Center 112 is similar to center 12. The cover layer 114 includes a filament material 116 embedded in a matrix material 118. The golf ball 110 further includes at least one intermediate layer 120 disposed between the center 112 and the cover layer 114. The intermediate layer 120 can be molded from conventional core compositions or cover compositions or may be a wound layer of elastic material. The intermediate layer has dimensions determined according to the characteristics desired.

The filament material 116 in this embodiment is preferably comprised of many individual fibers or strands as know by those of ordinary skill in the art. The fibers of the thread may be held together with a binder or they may be spun together. Melt spinning, wet spinning, dry spinning, and polymerization spinning may be used to produce threads. Once formed, the filament material 116 can be wound about the center 112 as discussed below.

The filament material 116 is considered continuous because the aspect ratio is as discussed above with respect to FIG. 1. The filament material is preferably coated with the matrix material 118 prior to winding. The pre-winding matrix material is represented by the matrix material 118 within the circle 113. The pre-winding matrix material preferably is the same material used as the post-winding matrix material. The pre-winding matrix material, however, may be a different material from the post-winding matrix material. For example, pre-winding matrix material may be selected to provide a relatively longer cure time so that it remains uncured until the winding is complete. Using this technique, the filament material 116 is substantially surrounded by the matrix material 118 so that there is little or no contact (i.e., no interface) between the filament material and the intermediate layer 120.

Any of the filament or matrix materials discussed above with respect to ball 10 can be used in the golf ball 110. In one preferred embodiment of golf ball 110, the filament material 116 is polyether urea, such as LYCRA®, as described above. In this preferred embodiment, the matrix material 118 is a polymer. The cover layer 114 is formed similar to cover 14 discussed below.

Figure 3:
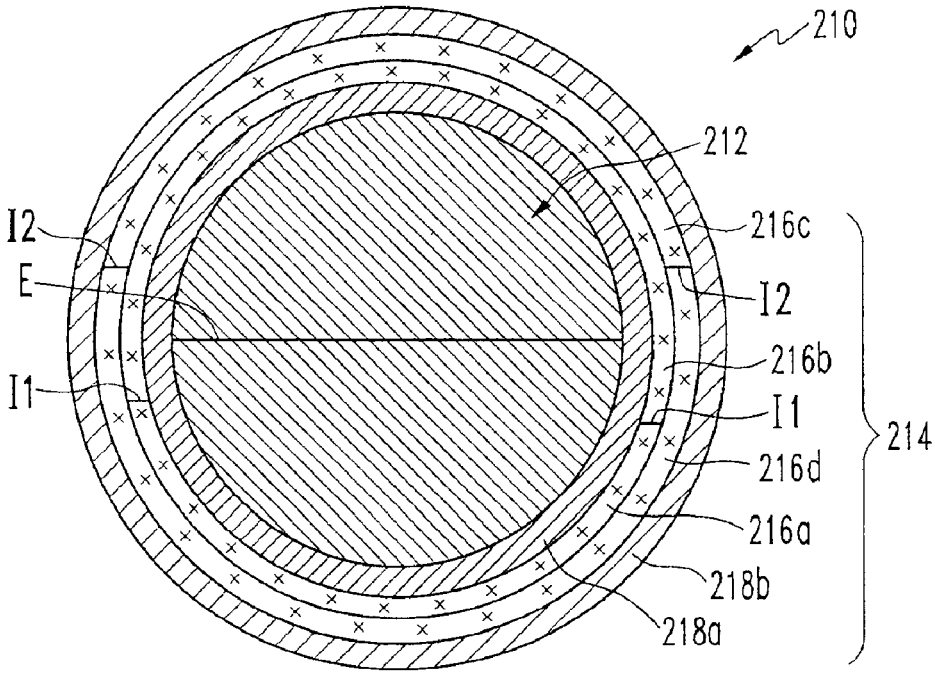
FIG. 3 is a schematic, cross-sectional view of a golf ball according to a third embodiment of the present invention with a center and a cover layer formed of the composite material.

Referring to FIG. 3, golf ball 210 is shown. Golf ball 210 includes center 212 and a surrounding cover layer 214. Center 212 is similar to center 12. The cover layer 214 includes a filament material 216*a–d* embedded in a matrix material 218*a,b*.

The filament material 216*a–d*, in this embodiment, is formed of a plurality of discrete pieces or segments of fibers disposed within the matrix material 218*a,b*. Preferably, the fibers form a mat and in this embodiment four mats 216*a–d* are formed. The mats 216*a,b* are disposed on the center 212. The mats 216*c,d* are disposed on the mats 216*a,b*. These mats can be woven such that the fibers of each mat are interconnected by the weaving process. Alternatively, the mats can be non-woven such that bonding between the fibers of each mat interconnect the fibers of each mat. The fibers of one mat may be oriented in a first direction and fibers of the adjacent mat may be oriented in a second direction different from the first direction. The number and orientation of the mats can be varied with consideration to the properties and composition of the filament material and matrix material, and importantly to achieve desired ball properties.

Any of the filament or matrix materials discussed above can be used in the golf ball 210. The matrix material 218*a,b* can be molded about the filament material 216*a–d* so that the filament material 216*a–d* is embedded in the matrix material 218*a,b* to form a single composite cover layer. The matrix material 218*a* can be the same as the matrix material 218*b* or matrix material 218*a* can be different from matrix material 218*b*. There is preferably no contact between the filament material and the center 212. In another embodiment, the filament material can be substantially but not completely out of contact with center 212. The details of forming the cover layer 214 are discussed below.

Figure 4:
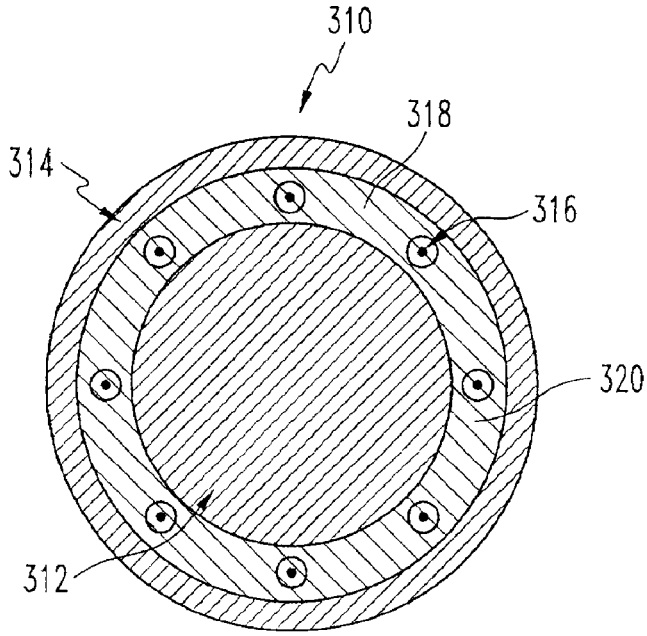
FIG. 4 is a schematic, cross-sectional view of a golf ball according to a fourth embodiment of the present invention with a center, an intermediate layer formed of the composite material, and a cover layer.

Referring to FIG. 4, golf ball 310 is shown. Golf ball 310 includes non-wound or molded center 312 and an outer cover layer 314. Center 312 is similar to center 12. Golf ball 310 further includes a filament material 316 embedded in a matrix material 318 of an intermediate or inner cover layer 320. The layer 314 is formed similarly to composite cover layer 114 of FIG. 2. The intermediate layer 320 is disposed between the center 312 and the outer cover layer 314. Additional intermediate layers can be added to golf ball 310 radially interior to the intermediate layer 320 or radially exterior to layer 320. These additional intermediate layers can be formed of conventional cover materials or of composite materials in accordance with the present invention.

The intermediate layer 320 thickness preferably ranges from about 0.020 inches to about 0.070 inches. More preferably, the thickness of the intermediate layer 320 is about 0.030 inches to about 0.040 inches, and most preferably the thickness of the intermediate layer 320 is about 0.035 inches.

The filament material 316, in this embodiment, is a single continuous fiber wound about the center 312. The filament material 316 is preferably pre-coated with matrix material 318 before being wound on center 312. Any of the filament or matrix materials discussed above can be used in the golf ball 310. The matrix material 318 is preferably molded about the filament material 316 so that the filament material 316 is embedded in the matrix material 318. The intermediate layer 320 can be formed similar to cover layer 14, and the details of forming the cover layer 14 are discussed below.

The cover layer 314 is formed of conventional cover layer materials such as balata, at least one ionomer, ionomer blends, non-ionomers or non-ionomer blends. For example, the cover can include highly neutralized polymers as disclosed in WO 01/29129 incorporated by reference herein in its entirety. The cover layer 314 can also be formed of single-site catalyzed polymers including non-metallocene and metallocene, polyurethane, polyurea, or a combination of the foregoing. Conventional cover forming techniques, such as injection molding, reaction injection molding, compression molding, and casting, can be used and the technique used depends on the material selected. Alternatively, the outer cover layer 314 can be similar to cover layers 14, 114, or 214 and include filament material and matrix material.

Figure 5:
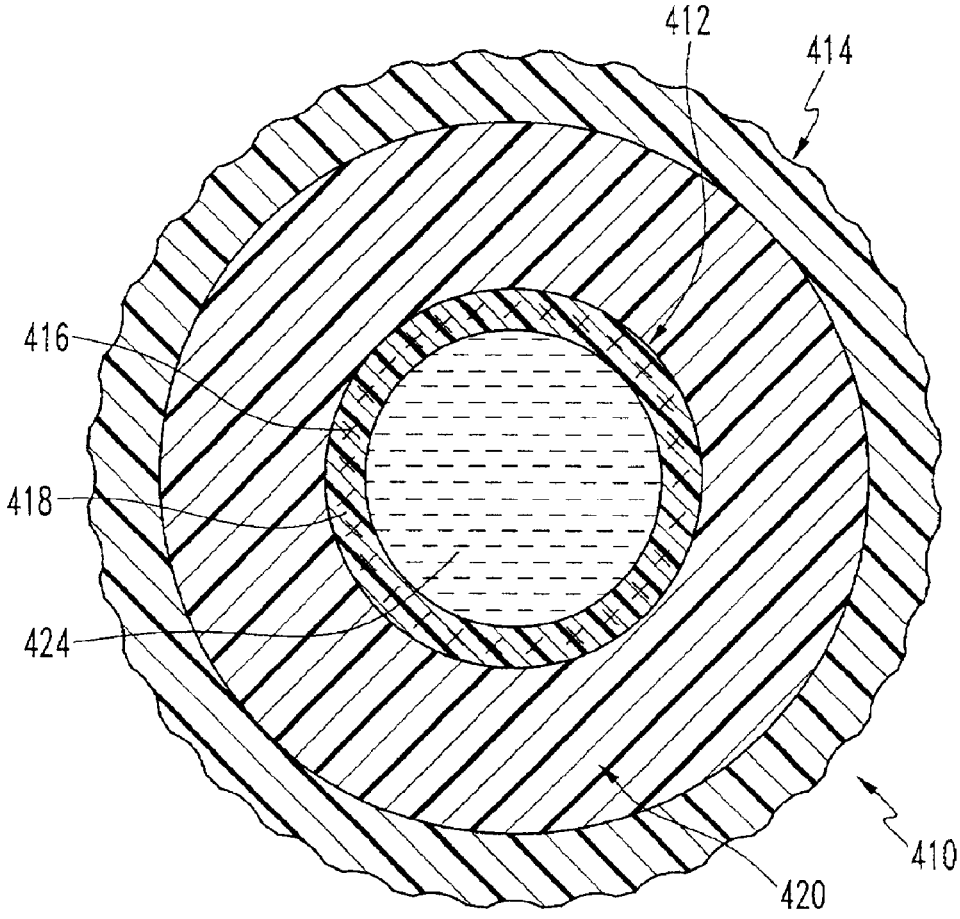
FIG. 5 is a schematic, cross-sectional view of a golf ball according to a fifth embodiment of the present invention including a center with a composite material envelope containing fluid, an intermediate layer, and a cover layer.

Referring to FIG. 5, golf ball 410 is shown. Golf ball 410 includes fluid-filled center 412 and cover layer 414. The center 412 includes a filament material 416 embedded in a matrix material 418. The golf ball 410 further includes at least one intermediate layer 420 disposed between the center 412 and the cover 414. The intermediate layer 420 is similar to the intermediate layer 120 and molded from conventional core compositions or cover compositions, and has dimensions determined according to the characteristics desired. Alternatively, the intermediate layer 420 may be wound.

The filament material 416 in this embodiment is preferably formed of discrete pieces or segments of fibers disposed or embedded within the matrix material 418 to form a composite material envelope. Any of the filament or matrix materials discussed above can be used in the golf ball 410. The composite material envelope is formed similar to cover layer 214 and the details of which are discussed below.

The composite material envelope is filled with a fluid 424 using conventional techniques. The envelope can be filled with a wide variety of materials including gas, water solutions, gels, foams, hot-melts, other fluid materials and combinations thereof. The fluid or liquid in the center can be varied to modify the performance parameters of the ball, such as the moment of inertia, weight, initial spin, and spin decay. Suitable gases include air, nitrogen and argon. Preferably, the gas is inert. Examples of suitable liquids include salt in water, corn syrup, salt in water and corn syrup, glycol in water, or oils. The liquid can further include water soluble or dispersable organic compounds, pastes, colloidal suspensions, such as clay, barytes, carbon black in water or other liquid, or salt in water/glycol mixtures. Examples of suitable gels include water gelatin gels, hydrogels, water/methyl cellulose gels and gels comprised of copolymer rubber based materials such a styrene-butadiene-styrene rubber and paraffinic and/or naphthionic oil. Examples of suitable melts include waxes and hot melts. Hot-melts are materials which at or about normal room temperatures are solid but at elevated temperatures become liquid.

The fluid can also be a reactive liquid system which combines to form a solid or create internal pressure within the envelope. Examples of suitable reactive liquids that form solids are silicate gels, agar gels, peroxide cured polyester resins, two part epoxy resin systems and peroxide cured liquid polybutadiene rubber compositions. Of particular interest are liquids that react to form expanding foams. It is understood by one skilled in the art that other reactive liquid systems can likewise be utilized depending on the physical properties of the envelope and the physical properties desired in the resulting finished golf balls.

The cover layer 414 is formed on the intermediate layer 420, and is similar to the cover layer 314 described above. Alternatively, the cover layer 414 can be similar to cover layers 14, 114, or 214 and include filament material and matrix material.

Figure 6:
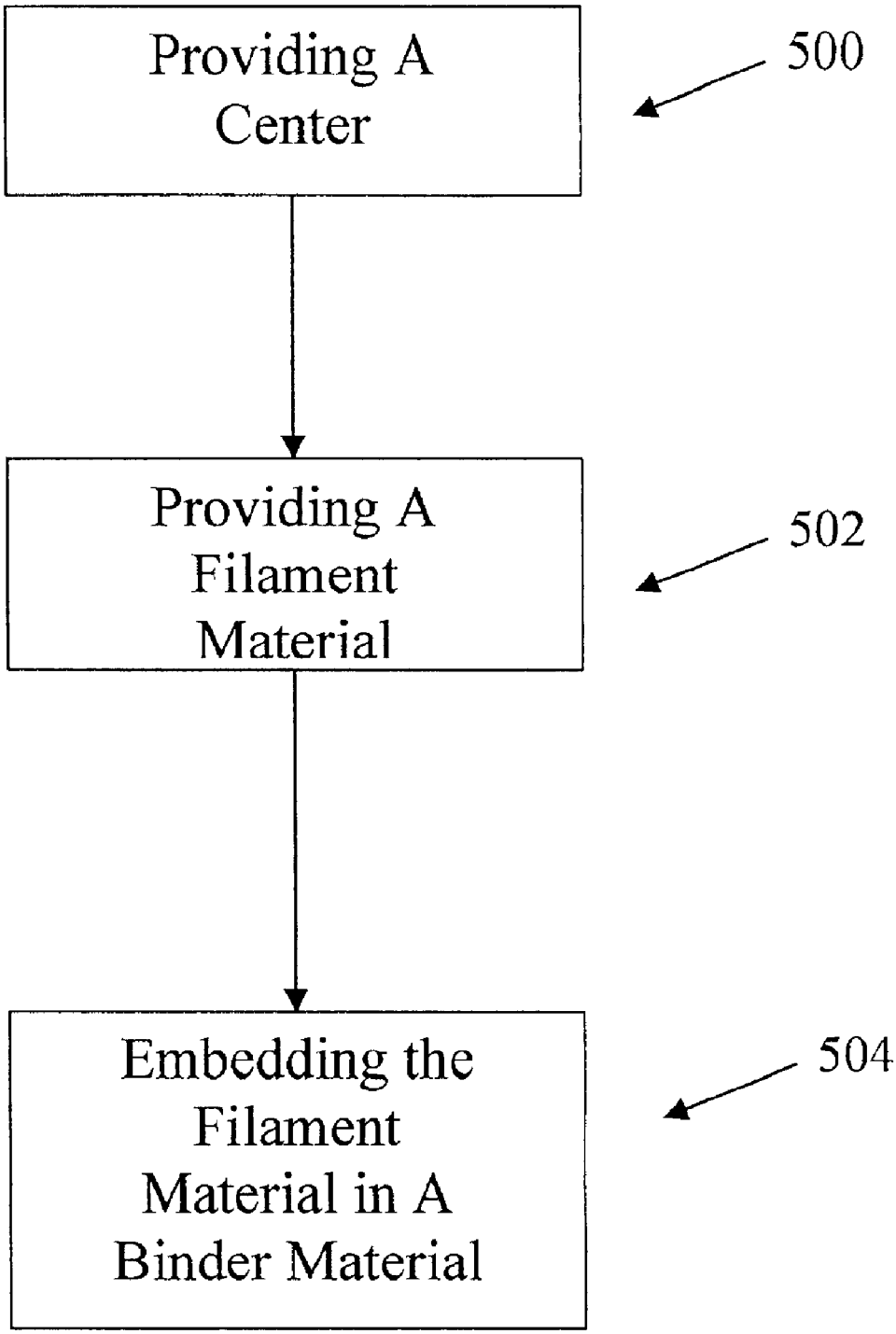
FIG. 6 is a flowchart showing steps included in a method of forming a golf ball according to the present invention.

Referring to FIGS. 1 and 6, steps 500–504 are used in a method of forming the golf ball 10 of the present invention, which will now be discussed. The method includes the step 500 of providing the center 12. This includes the further steps of mixing the material that forms the center 12, and forming the material into the spherical center 12, as known by those of ordinary skill in the art. The center 12 can be formed using, for example, injection or compression molding.

The method also includes the step 502 of providing the filament material 16 about the center 12 to form a golf ball subassembly. In this embodiment, step 502 further includes forming a single continuous thread or fiber as discussed in the Bissonnette et al. patent, and winding the fiber about the center. A winding machine such as that disclosed in U.S. Pat. No. 4,783,078 to Brown et al. or U.S. Pat. No. 6,290,610 to Reid, Jr. et al. can be used to apply a fiber or tow to a center. The Brown et al. patent and the Reid, Jr. et al. patent are incorporated by reference herein in their entirety. Using such winding machines, tension can be applied to the fiber that stretches or elongates the fiber during winding.

Referring to FIG. 1, the winding pattern for the filament material 16 can be axial so that the fiber is wound about a single axis or biaxial. For example, winding patterns such as great circle and criss-cross can be used at various times during winding and used alone or in combination with one anther or in combination with other winding patterns.

Referring again to FIGS. 1 and 6, step 504 of embedding the filament material 16 into the matrix material 18 further includes molding the matrix material 18 onto the golf ball subassembly to form cover layer 14. The cover layer 14 can be formed using for example, injection or compression molding.

Referring to FIGS. 2 and 6, the method of making golf ball 110 will now be discussed. Similar to the method of making the golf ball 10, the method of making ball 110 includes the step 500 of providing the center 112, which is made as discussed above. Then, an intermediate layer 120 is formed on the center 112 by molding or winding. Next in step 502, the filament material 116 is provided. In one embodiment, this is done by winding the filament material 116 about the intermediate layer 120.

Figure 7:
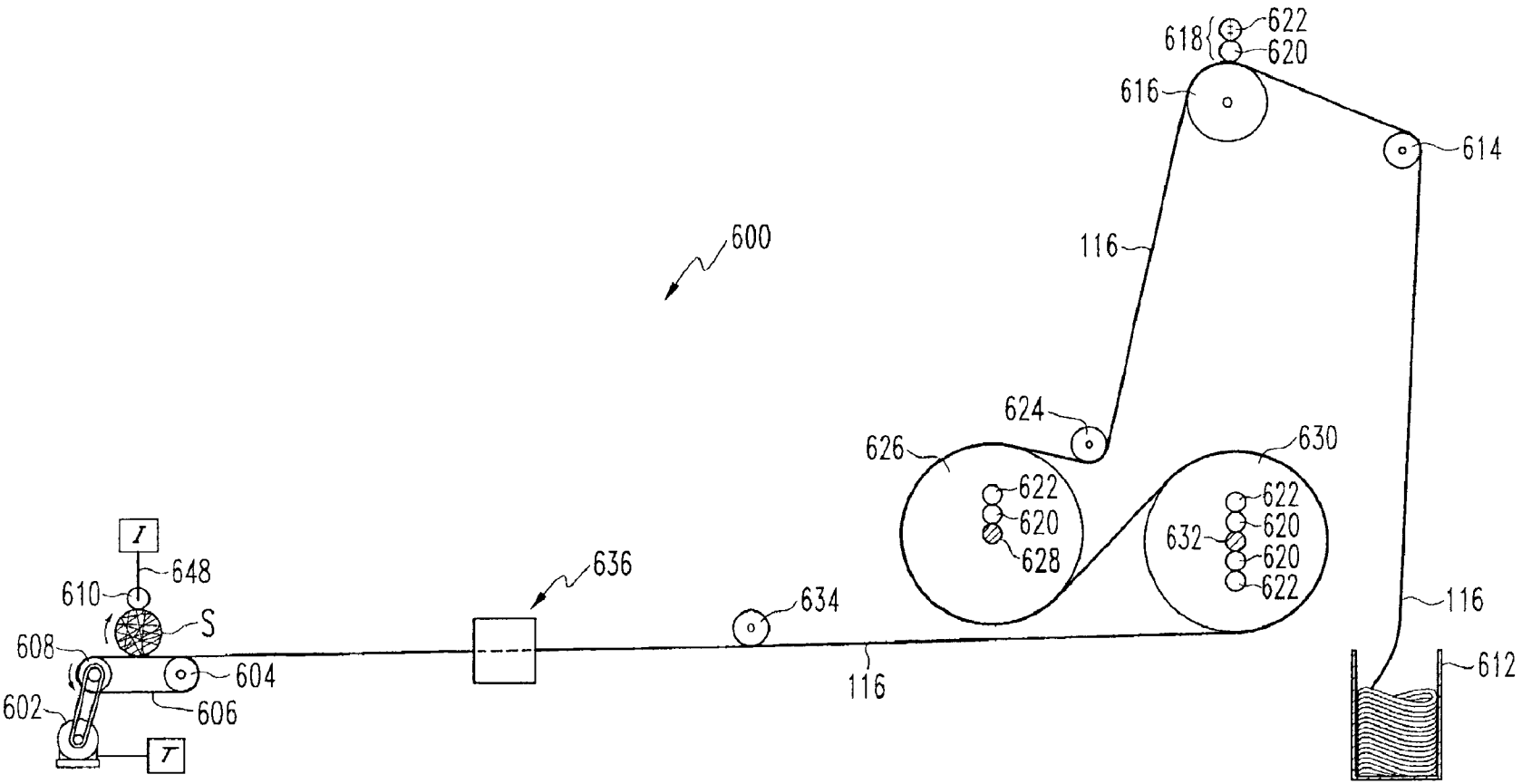
FIG. 7 is schematic, elevational view of a winding apparatus for use in forming a golf ball of FIGS. 2 and 4 of the present invention.

Referring to FIG. 7, to form ball 110 a winding apparatus 600 may be used. The winding apparatus 600 includes a motor 602, which drives a wheel 604. A rubber belt 606 operatively connects wheel 604 to drive wheel 608. A wheel 610 bears on golf ball subassembly S including center 112 and intermediate layer 120 (shown in FIG. 2), and bears subassembly S into contact with the belt 606. As the center turns, it draws filament material 116 through a tensioning system from a supply box 612 of filament material. From the supply box 612, the filament material 116 first passes over an idler roll 614 and then to a tension wheel 616. The tension wheel 616 preferably has a groove (not shown) in which the filament material 116 travels. The groove may be of less depth than the thickness of the filament material so that tension apparatus 618 can apply nip-like pressure on the filament material. Tension apparatus 618 comprises a rubber tension wheel 620 and a metal tension wheel 622. Metal wheel 622 is biased for up and down movement. When it is up, no tension is applied to the filament material. During normal winding operations, metal wheel 622 is in the down position and causes rubber wheel 620 to engage the filament material. The rubber wheel 620 in combination with wheel 616 essentially acts like a nip roller with respect to the filament material.

From this initial tension apparatus 618, the filament material 116 travels around idler roll 624 to low tension wheel 626. Low tension wheel 626 has tension wheels 620 and 622, which are the same as those in tensioning apparatus 618. In this case, however, the tension wheels 620 and 622 bear against axle 628 of low tension wheel 626. It will be appreciated that the pressure which is applied to axle 628 by tension wheels 620 and 622 will directly affect the degree of stretch of the filament material 116 as it is wound onto the golf ball subassembly S. While tension increases between tension wheel 626 and subassembly S, the rate of feed of filament material 116 may be the same since that is solely dependent on the rate of feed through tension apparatus 616.

After low tension wheel 626, the filament material 116 passes over high tension wheel 630. In order to be able to exert sufficient force on axle 632 of high tension wheel 630, there are two pairs of tension rollers 620 and 622. After the filament material leaves high tension wheel 630, it goes past idler roller 634. Down stream of the idler roller 634 and upstream of the subassembly S, the filament material 116 passes through an applicator 636 that substantially coats the filament material 116 before it is wrapped about the subassembly S. The applicator can be for example, a solvent bath or a fluidized bed, among other apparatus as known by those of ordinary skill in the art.

As the size of the golf ball subassembly S increases due to the addition of more filament material, wheel 610 rises and rod 648 attached thereto also rises. Rod 648 can suitably be the core of a transducer, which can serve as an indicator I of the then diameter of the golf ball subassembly S. A timer T can be used in conjunction with motor 602. Preferably, the matrix material 118 is maintained in a liquid state during the winding process by, for example, heating wheel 610 and/or belt 606 or winding in a heated chamber.

Low tension wheel 626 may always be engaged while motor 602 is in operation. High tension wheel 630 may not be operated during the initial period of winding so that only low tension is being applied to the filament material initially. At a pre-selected point, tension may be applied to high tension wheel 630. The instance of engagement of high tension wheel 630 can be determined by timer T and/or by indicator I. As the filament material winds about the subassembly S, the size of the golf ball subassembly S increases. During this winding, the filament material is substantially coated with matrix material prior to contacting golf ball subassembly.

Referring again to FIG. 6, step 504, of applying the matrix material includes applying the matrix material before winding. Additionally, matrix material can be applied such as by molding or casting after the winding is complete. As a result, the golf ball 110 (as shown in FIG. 2) includes filament material 116 that is out of contact with the intermediate layer 120 and substantially covered by matrix material 118. The additional matrix material applied after winding intermingles with the pre-applied matrix material to form a single layer cover 114.

A method similar to that used for golf ball 110 can also be used to form intermediate layer 320 of golf ball 310 as shown in FIG. 4.

Referring to FIGS. 3, 5, and 6, when discrete pieces of fiber 216 and 416 are used, the step 502 of providing the filament material can include milling the filament base material and chopping the material into discrete or non-continuous pieces 216 and 416. These pieces 216 and 416 can be formed into a planar mat or network using non-woven techniques, such as wet lay techniques, dry lay techniques, spun bond techniques or the like. Alternatively, the pieces of fiber can be formed into a mat using woven techniques. Regardless of the technique used, the fibers 216 and 416 once in the mat are interconnected to share any loading that occurs.

Referring to FIG. 3, preferably center 212 of the golf ball 210 has been coated with matrix material 218*a*. This can be done by methods such as dipping the center 212 in matrix material 218*a*, spraying the material 218*a* on the center 212, molding the material 218*a* on the center 212, forming the material 218*a* into hemispherical shells that are disposed about the center 212, and the like. Subsequently, the mats 216*a–d* are positioned on the golf ball subassembly (including the center 212 and material 218*a*) in an at least partially overlapping manner. Mats 216*a* and *b* preferably form an inner layer of filament material. Mats 216*c* and *d* preferably form an outer layer of filament material. The mat 216*a* does not extend past the equator E of the center 212, however mat 216*b* extends past the equator E of the center 212. The mat 216*c* does not extend past the equator E of the center 212, however mat 216*d* extends past the equator E of the center 212. In this manner, the mats have discontinuous interfaces I1 and I2 therebetween. The mats 216*a* and 216*c* have fibers at a different orientation than the fibers within mats 216*b* and 216*d*. This provides the necessary strength characteristics for the cover layer 214.

The number of mats and number mat layers or plies is not limited to that disclosed herein and can be determined by the necessary characteristics of the cover. In addition, the orientation of the fibers can be determined by the desired characteristics. In this embodiment, the fiber mats are laid up on the center 212. In another embodiment, the fiber mats can be formed into hemispherical shells by methods such as thermoforming and the shells can be placed on the center 212 as discussed above. For example, when the composite cover includes thermoplastic matrix material and glass fibers, shells of matrix material and shells of glass fibers can be thermoformed individually then stacked together into laminates and compression molded over the center.

In one preferred embodiment, mats 216*a–d* are hemispherical mats, and these mats are positioned such that the interface I1 between mats 216*a* and *b* is not parallel to the interface I2 between mats 216*c* and *d*. Preferably, these two interfaces I1 and I2 are perpendicular to each other. The present invention is not limited to this configuration, however, and two or more pairs of substantially hemispherical mats may be used in various orientations, such that the interfaces of the adjacent pairs are not aligned with one another.

In another embodiment, mats 216*a–d* can each have a three-quarter spherical shape. In this embodiment, when positioned on center 212, mats 216*a* and *b* substantially overlap each other and mats 216*c* and *d* overlap each other. Mats 216*a–d,* however, may have any spherical shape, from semi-spherical to substantially fully spherical. Alternatively, mats 216*a–d* may be fully spherical with a slit thereon for center 212 to be inserted therein.

Figure 8:
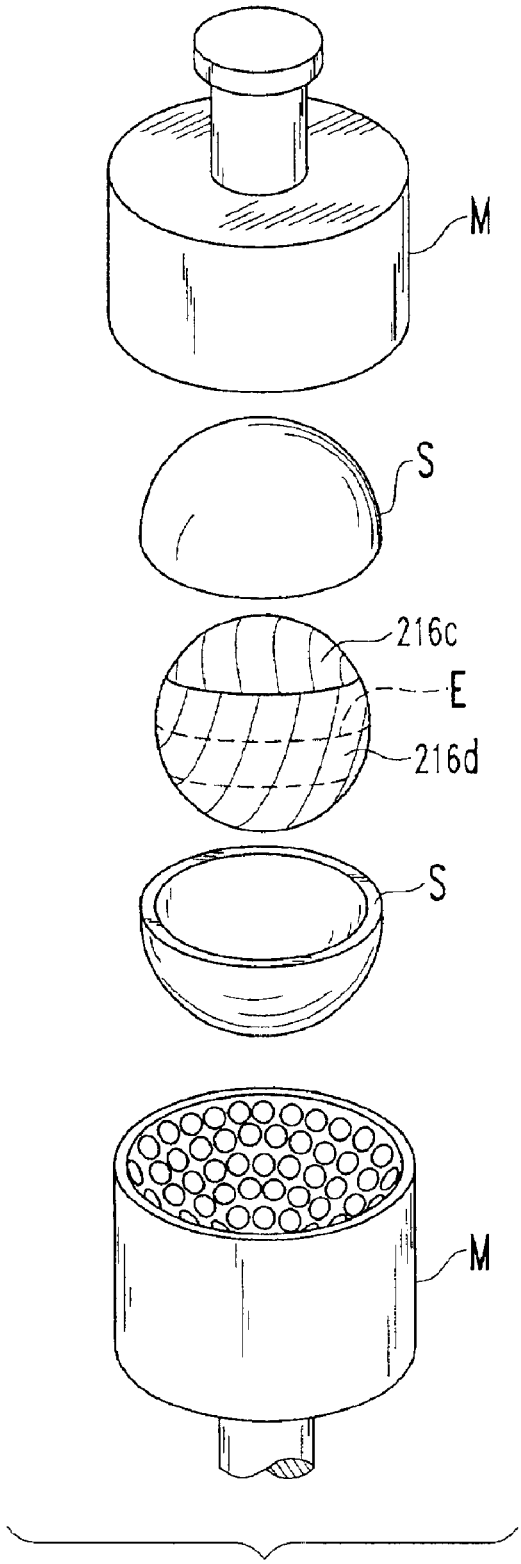
FIG. 8 is an enlarged, perspective view of a method of forming the golf ball of FIG. 3.

Once the necessary mats are placed, the additional shells S, as shown in FIG. 8 of matrix material 218*b* are disposed about the golf ball subassembly. Mold halves M with projections therein can be closed about the shells S and center 212 to form the cover layer 214 with dimples therein.

The matrix material can also be provided in a prepreg form as part of the fiber mat, sprayed-up, compression molded, resin transfer molded, injection molded. Preferably, the filament material has a length greater than about 1 mm. The filament material can have any cross-sectional shape such as, rectangular, circular, or formed of a plurality of fibers in a bundle.

While various descriptions of the present invention are described above, it is understood that the various features of the present invention can be used singly or in combination thereof. For example, the golf ball can include a multi-layer cover. The features of one embodiment can be used with the features of another embodiment. Therefore, this invention is not to be limited to the specifically preferred embodiments depicted therein.

We claim:

1. A golf ball comprising:

a center; and at least one layer surrounding the center, the layer formed of a composite material comprising:

a matrix material, a filament material embedded in the matrix material such that a ratio of a filament material tensile modulus to a matrix material tensile modulus is between about 20 and about 120, and a coupling agent as an interface between the filament material and the matrix material.

2. The golf ball of claim 1, wherein an ultimate tensile strain of the filament material is greater than about 4%.

3. The golf ball of claim 1, wherein the layer is a single cover layer that forms the outer surface of the golf ball.

4. The golf ball of claim 1, wherein the filament material is formed of a plurality of fibers.

5. The golf ball of claim 4, wherein the fibers are formed of a material selected from the group consisting of glass and polymeric material.

6. The golf ball of claim 4, wherein the filament material forms a woven mat.

7. The golf ball of claim 4, wherein the filament material forms a non-woven mat.

8. The golf ball of claim 1, further including an intermediate layer surrounding the center and a cover layer surrounding the intermediate layer, wherein the intermediate layer is disposed between the layer surrounding the center and the cover layer and includes the composite material and has a thickness from about 0.020 inches to about 0.070 inches.

9. The golf ball of claim 1, wherein the layer forms an envelope surrounding the center, and the center comprises fluid.

10. The golf ball of claim 4, wherein an aspect ratio of each fiber in the filament material is greater than 10,000.

11. The golf ball of claim 1, wherein the ratio of a coefficient of thermal expansion of the matrix material to a coefficient of thermal expansion of the filament material is less than 20.

12. The golf ball of claim 1, wherein the filament material includes at least some fibers formed of a shape memory alloy.

13. The golf ball of claim 12, wherein the shape memory alloy can be selected from the group including: Ag—Cd, Cu—Al—Ni, Cu—Sn, Cu—Zn, Cu—Z—Si, Cu—Zn—Sn, Cu—Z—Al, In—Ti, Ni—Al, Ni—Ti, Fe—Pt, Mn—Cu, and Fe—Mn—Si.

14. The golf ball of claim 1, wherein the filament material includes at least some fibers formed of a non-shape memory alloy.

15. A golf ball comprising:

a center; and a first cover layer surrounding the center, the first cover layer formed of a composite material comprising:

a matrix material having a first tensile modulus less than about 80,000 psi, and a filament material formed of a plurality of fibers embedded in the matrix material to form a woven mat and having a second tensile modulus substantially greater than the first tensile modulus.

16. The golf ball of claim 15, wherein the first tensile modulus is greater than about 500 psi.

17. The golf ball of claim 16, wherein the second tensile modulus is greater than about 30,000 psi.

18. The golf ball of claim 15, wherein the filament material has an ultimate tensile strain of at least about 4%.

19. The golf ball of claim 15, wherein the composite material has tensile modulus of between about 20,000 psi and about 250,000 psi.

20. The golf ball of claim 15, wherein the filament material is formed of a plurality of fibers.

21. The golf ball of claim 15, wherein the filament material is selected from a group consisting of polymeric materials and glass materials.

22. The golf ball of claim 15, wherein the matrix material is selected from a group consisting of thermosets and thermoplastics.

23. The golf ball of claim 22, wherein the matrix material comprises polyamides, polyurethane, polyurea, polybutadiene, an ionomer or blends thereof.

24. The golf ball of claim 15, further comprising an intermediate layer formed of the composite material, said intermediate layer surrounds the center and is disposed between the center and the first cover layer, and a second cover layer surrounds said intermediate layer.

25. The golf ball of claim 24, wherein the second cover layer is formed from a material selected from the group consisting of balata, at least one ionomer or blends of ionomers including highly neutralized polymers, a single site catalyzed polymer, polyurea, poly(ether-ester), poly (ether-amide), single-site catalyzed polyolefinic polymer, polyurethane, and silicone material.

* * * * *